US005375567A

United States Patent [19]

Lowi, Jr.

[11] Patent Number: 5,375,567

[45] Date of Patent: Dec. 27, 1994

[54] ADIABATIC, TWO-STROKE CYCLE ENGINE

[76] Inventor: Alvin Lowi, Jr., 2146 Toscanini Dr., Rancho Palos Verdes, Calif. 90732

[21] Appl. No.: 112,887

[22] Filed: Aug. 27, 1993

[51] Int. Cl.[5] ..... F02B 75/26

[52] U.S. Cl. ..... 123/56.8; 123/56.9

[58] Field of Search ..... 123/58 AM, 58 A, 58 AB, 123/51 B, 193.6; 92/212

[56] References Cited

U.S. PATENT DOCUMENTS

| | | | |
|---|---|---|---|
| 1,339,276 | 5/1920 | Murphy | 123/58 AB |
| 1,466,144 | 8/1923 | Murphy | 123/58 AB |
| 1,788,140 | 1/1931 | Woolson | 123/58 AM |
| 1,808,083 | 6/1931 | Tibbetts | 123/58 AM |
| 2,076,334 | 4/1934 | Burns | 123/58 AM |
| 2,080,846 | 5/1937 | Alfaro | 123/58 AM |
| 2,243,817 | 5/1941 | Herrmann | 123/58 |
| 2,243,818 | 5/1941 | Herrmann | 123/173 |
| 2,243,819 | 5/1941 | Herrmann | 123/196 |
| 2,243,820 | 5/1941 | Herrmann | 123/56 |
| 4,466,399 | 8/1984 | Hinz et al. | 123/193.6 |
| 4,751,871 | 6/1988 | Burghardt et al. | 92/212 |
| 4,791,787 | 12/1988 | Paul et al. | 60/605.1 |
| 4,856,463 | 8/1989 | Johnston | 123/51 BA |
| 5,215,045 | 6/1993 | Vadnjal | 123/58 A |

OTHER PUBLICATIONS

P. M. Heldt, Dec. 1943, "High Speed Diesel Engines," Fourth Ed., pp. 308–311, 320–327.

S. G. Timoney, Dec. 1965, "Diesel Design for Turbocharging," SAE Paper 650007.

John C. Basiletti and Edward F. Blackburne, Dec. 1966, "Recent Developments in Variable Compression Ratic Engines," SAE Paper 660344.

L. J. K. Setright, "Some Unusual Engines," Dec. 1975, pp. 99–105, 109–111.

R. Kamo, W. Bryzik and P. Glance, Dec. 1987, "Adiabatic Engine Trends Worldwide," SAE Paper 870018.

S. G. Timony, M. H. Farmer and D. A. Parker, Dec. 1987, "Preliminary Experiences with a Ceramics Evaluation Engine Rig," SAE Paper 870021.

Paul and Humprheys, Apr. 1952, SAE Transactions No. 6, p. 259.

*Primary Examiner*—Tony M. Argenbright
*Assistant Examiner*—M. Macy
*Attorney, Agent, or Firm*—Bruce M. Canter

[57] ABSTRACT

An engine structure and mechanism that operates on various combustion processes in a two-stroke-cycle without supplemental cooling or lubrication comprises an axial assembly of cylindrical modules and twin, double-harmonic cams that operate with opposed pistons in each cylinder through fully captured rolling contact bearings. The engine may comprise one or more pairs of axially symmetric cylinder modules which with their opposed pistons perform perfectly balanced reciprocating and rotary motions at all loads and speeds. The opposed pistons are double-acting, performing a two-stroke engine power cycle on facing ends and induction and scavenge air compression on their outside ends, all within the same cylinder bore.

30 Claims, 9 Drawing Sheets

ADIABATIC, TWO-STROKE CYCLE ENGINE

FIELD OF INVENTION

This invention relates to uncooled, two-stroke-cycle, internal combustion engines, especially to engines of improved power density, smoothness, efficiency and output torque that can operate without the use of external cooling appurtenances, having particular application to propshaft propulsion of lightweight, subsonic, high altitude aircraft as well as a variety of other engine power functions.

BACKGROUND—DESCRIPTION OF PRIOR ART

Heretofore, internal combustion engines of the reciprocating type have been constructed of metals in forms best suited for their fabrication in such materials. However, due to these materials prior art engines require supplemental cooling and lubrication in order to function properly with adequate durability. These cooling and lubrication requirements further require provisions for fluid circulation and heat rejection accessories that can be burdensome in many applications. Aircraft applications of such engines are particularly sensitive to the installation of such accessories because of the weight and aerodynamic drag associated with their proper usage. In addition, the control of fluids in aircraft engines and their remote accessories such as radiators, oil coolers, pumps, oil sumps and the like is complicated because a fixed gravitational orientation can not be relied upon to disengage vapors and liquids and establish fluid levels.

A further disadvantage of most prior art engine constructions for aircraft applications is their dependence on increased output shaft speed as a means of reducing weight per unit of power output. Because propellers function efficiently only with limited rotational speeds, most light-weight engines of the prior art type require speed-reducing gear boxes, and perhaps even variable ratio transmissions, to properly match their outputs to suitable propellers. Such mechanical accessories have cooling and lubrication requirements of their own and can add significant weight, .cost and complexity to the installation, particularly for small-engine and high-altitude applications. Such speed constraints are not limited to aircraft applications. Certain alternators and compressors represent other important drive applications that are so limited.

Most prior art engines employ structural arrangements, assemblies and mechanisms that are highly dependent on the tensile properties of the customary metallic materials which have limited temperature tolerance, expand significantly when heated and are prone to galling under sliding and rubbing contact. They require sophisticated cooling and lubrication schemes to maintain their mechanical and structural integrity and their weight and balance is highly sensitive to increases in cylinder working pressures and rotational speeds. Thus, prior art engines that operate on the diesel cycle are somewhat heavier and larger than their spark ignition counterparts and they also present greater lubrication, cooling and balancing burdens. This accounts, to a large extent, for the lack of acceptance, heretofore, of prior art type diesel engines for aircraft applications notwithstanding their potentially superior flight-worthiness, safety, fuel economy and fuel flexibility characteristics.

Various attempts have heretofore been made to overcome some of these problems by designing diesel engines with large heat retention capacities. Examples of such "adiabatic engine" are those manufactured by Adiabatic Inc. and Cummins. These adiabatic engines utilize insulated parts, heat tolerant components and high-temperature tribology or friction controls. However, such friction controls require advanced chemistry for liquid lubrication. What is needed is an adiabatic engine that overcomes these shortcomings.

With rare exceptions, prior art reciprocating engines, adiabatic or otherwise, utilize crankshafts and connecting rods for the translation of reciprocating to rotary motion. This arrangement has been successfully applied to engines comprised of from one to many cylinders laid out in various configurations such as in a single line of cylinders parallel to the crankshaft, banks of inline cylinders disposed around the crankshaft, radial cylinder dispositions and opposed-piston arrangements using one or more crankshafts geared together. A few crankshaft-type engines are known which have been constructed with parallel cylinders axially aligned in a barrel arrangement around the crankshaft or with inline cylinders transverse to the crankshaft. Both of these types rely on additional auxiliary mechanisms such as gear trains, rocker arms, wobble plates, universal ball joints and the like for the translation of power.

Prior art engines that utilize crankshafts provide no mechanical advantage in the conversion of piston motion to shaft torque. Furthermore, eccentricities in connecting rods and the like produce side loads in the reciprocating pistons which give rise to friction and vibration. Another disadvantage of crankshaft-type engines is the complex load path that must be structurally accommodated in maintaining the mechanical integrity of the engine. Typically, such loads are passed through the cylinder walls which must also handle the stresses due to combustion. As a result, the cylinders must be constructed of materials having high tensile strengths. Due to the complex forms of the structures required, metallic materials constitute the only economic and durable means of construction, and then only if an abundance of cooling and lubrication is used. Furthermore, crankshafts, by nature, must span the length of the engine. Because of this, as well as a poor structural geometry for the loads imposed, crankshaft engines require somewhat more weight, strength and stiffness in the shaft, bearings and supporting structure to obtain an adequate degree of torsional rigidity and structural integrity.

The axial piston or barrel configuration typified by the prior art engines of Herrmann, Sterling/Michel and others offers improved compactness, structural efficiency and frontal area. These characteristics are desirable for an engine. However, none of these characteristics has been obtained in the prior art with the use of thermally tolerant and self-lubricated materials in the principal parts. All of these prior art engines rely on the established principles of ironmongery, which succeeds only with proper cooling and lubrication. None of the prior art engines suggests the use of non-metallic construction or arrangements, hence, the burdens of supplemental cooling and lubrication remains.

Many of these prior art engines, such as Junkers, Hill and Sterling/Michel, have utilized opposed-piston arrangements which avoid the use of cylinder heads and the stresses, dynamic forces, seals, attachments and fastenings attendant thereto. Although this arrangement is limited to two-stroke-cycle operation, this can be advantageous for some applications, provided aspiration and cylinder scavenging can be properly attended. Other advantages of the opposed-piston arrangement include reduced combustion chamber heat losses, improved compactness for a given cylinder displacement and reduced piston speed for a given power output.

For example, the Sterling/Michel engine includes an opposed piston arrangement that utilizes a double swashplate for translating axial to reciprocating motion (see, Heldt, P. M., *High Speed Diesel Engines,* 4th Ed., Nyack, N.Y., 1943, pp. 308–309). However, the Sterling/Michel engine has swashplate followers which impart significant side loads. Furthermore, the engine requires a separate scavenging system and supplemental lubrication. Finally, the Sterling/Michel swashplates are single harmonic, thereby yielding only one power stroke per revolution.

The Junkers engine utilizes two crankshafts in an inline cylinder, opposed piston configuration, thus also yielding only one power stroke per revolution (see Heldt, pp. 320–326). Furthermore, the articulated piston/crankshaft arrangement imparts significant side loads as well. The Junkers engine also utilizes a separate scavenging system, requiring appurtenances which add to the complexity and weight of the engine structure.

The Hill engine has opposed pistons with a single crankshaft/rocker arm assembly that is transverse to the center of the cylinder (see Heldt, p. 310). Thus, it too has side load problems.

Sterling/Michel, Junkers and Hill all used opposed pistons, but none foresaw the opportunity for constructing their engines in a manner that could utilize in any significant respect thermally tolerant and self-lubricated materials. Further, all utilize reciprocating-to-rotary conversion mechanisms that impart side loads on their pistons and which cannot provide any mechanical advantage in the production of torque other than by the familiar method of increasing the piston stroke and/or combustion pressure. Finally, none of these prior art engines included integral aspiration and scavenging means, thus necessitating external or add-on appurtenances such as additional scavenge pump cylinders or separate mechanically-driven blowers.

There is a recently disclosed (date unknown), two-stroke-cycle, opposed piston engine which has significantly reduced or eliminated side loads on the pistons (see the DARPA/Land System Office engine in the Advanced Research Projects Agency Brochure, page 38). This engine utilizes four crankshafts, two counter-rotating crankshafts on each cylinder end. Due to the counter-rotating crankshafts, each having opposing connecting rods attached to a piston, the net side load on each piston is approximately zero. However, this engine structure is mechanically very complicated and does not lend itself to the use of thermally tolerant materials.

Another prior art engine, that of Herrmann (U.S. Pat. Nos. 2,243,817, 818, 819, and 820, all issued in 1941) teaches the use of a double harmonic barrel cam engine. The Herrmann engine utilizes a single cam arrangement in a four-stroke cycle axial cylinder configuration having improved torque multiplication, reduced piston side loads and lower torsional vibrations in the output shaft. However, Herrmann did not anticipate or suggest the use of double-harmonic cams in an opposed piston engine having an axial cylinder arrangement. Furthermore, Herrmann's engine operates on a four-stroke-cycle. Thus, even though Herrmann's double harmonic cam increases the number of piston strokes per shaft revolution, it only obtains one power stroke per revolution. Any further increase in torque output would require the use of a two-stroke-cycle engine. Such an attempt to utilize the Herrmann single cam teachings in a two-stroke-cycle engine would be encumbered by the need for highly stressed cylinder heads and difficult valving and porting locations which necessitate the use of cooled and lubricated metallic construction.

Various prior art engines have disclosed the advantages of a variable compression ratio in a reciprocating engine and several means for accomplishing this during engine operation are well known. Wallace and Lux (SAE Transactions No. 72 p. 680, 1964), for example, disclose a means of controlling the clearance volume of the cylinder by hydraulically positioning the piston crown above the piston pin. This technique is burdened with the complexity of supplying hydraulic fluid in a controllable manner through rotating and reciprocating members into the most intensely heated and highly stressed region of the engine, namely the piston crown. Another method known in the art is one disclosed by Paul and Humpreys (SAE Transactions No. 6, p. 259, April, 1952) in which the cylinder head of the engine is spring-loaded to allow the clearance volume to change with increased cylinder pressure. This method is mechanically and structurally complex and it also requires intense cooling of the springs in order to prevent premature failure of the mechanism. Still another method of varying the compression in operation applies only to a rocking-beam type opposed piston engine as disclosed by Clark and Skinner (SAE Paper 650516, 1965), wherein a variable compression system was integrated into the Hill engine. This method changes the piston stroke and, thus the total cylinder displacement, by simultaneously altering the rocker ratio between a single transverse crankshaft and the twin connecting rods of the opposed pistons. This technique utilizes a pair of eccentric rocker shafts that are synchronously rotatable within heavily loaded bearings which requires a precise and robust mechanism having critical lubrication problems. In fact, all of the prior art mechanisms described above are vulnerable to intense heat and load exposure.

The history of the internal combustion engine contains an abundance of examples of engines constructed with unusual means for the translation of power (see, for example, Setright, L. J. K., Some Unusual Engines, Mechanical Engineering Publications, Ltd., London, 1975). Whatever the various advantages offered by many of these prior art examples, none overcomes the structural, thermal, mechanical, dynamic and frictional limitations that have been a barrier, heretofore, to the construction of an engine that can operate free of vibration, supplemental cooling and lubrication.

SUMMARY OF THE INVENTION

What is provided by the engine of my invention is a two-stroke-cycle, adiabatic engine that is structurally compact and can operate free of vibration. The engine is capable of utilizing thermally tolerant materials, thereby obviating the need for supplemental cooling and lubrication. The engine comprises an axial assembly of cylindrical modules and twin, double-harmonic cams that operate with opposed pistons in each cylinder through fully captured rolling contact bearings. The engine may comprise one or more pairs of axially symmetric cylinder modules which with their opposed pistons perform perfectly balanced reciprocating and rotary motions at all loads and speeds. The opposed pistons are double-acting, performing a two-stroke engine power cycle on facing ends and induction and scavenge air compression on their outside ends, all within the same cylinder bore.

The benefits of the structure of my engine are the elimination of side loads on the pistons, tensile stresses in the cylinders and unbalanced forces in its structure, while accomplishing a variable compression ratio, self-aspirated, self-scavenged two-stroke-cycle engine having improved thermal tolerance, smoothness, compactness and weight characteristics. As will be shown in the following, the engine of my invention, having no cylinder heads, crankshafts or connecting rods, can utilize lightweight, self-lubricated, thermally-tolerant materials such as graphite and silicon nitride ceramics in a structurally, thermally and mechanically efficient manner whereby to accomplish an engine of improved characteristics for high-altitude, subsonic aircraft propulsion and other engine power applications.

The advantages of my engine invention over the prior art mentioned above include minimal heat rejection, minimum weight, maximum balance, maximum smoothness, structural simplicity, maximum torque for minimum displacement, self-scavenging, and compactness. It also provides a simple and effective means of varying the compression ratio during operation without having to contend with critical structural, cooling and lubrication problems.

OBJECTS AND ADVANTAGES

Accordingly, the several objects and advantages that my reciprocating, internal combustion heat engine invention accomplishes are:

1. Operation in a two-stroke-cycle without external or add-on aspiration and scavenging accessories or cylinder heads;

2. Attainment of improved thermal efficiency through reduced heat losses and friction by permitting the utilization of thermally-tolerant, self-lubricated materials, preventing piston side loads and using an all-rolling-contact mechanism for converting reciprocating motion to shaft rotation;

3. Achievement of improved torque output with reduced shaft speed and piston displacement by using twin double-harmonic cams, opposed pistons and a two-stroke-cycle;

4. Attainment of improved smoothness by balancing all reciprocating masses, pressure forces and dynamic moments and by the substantial reduction of torsional variations in the output shaft;

5. Facilitation of the utilization of lightweight, thermally-tolerant materials such as graphite and ceramics in a structurally efficient arrangement that does not require supplemental cooling or lubrication and achieves great torsional rigidity and structural integrity;

6. Attainment of high power density and specific power output using diesel cycle operation for the attainment of maximum fuel economy, flexibility, safety and reliability;

7. Attainment of high compression ratios for ease of starting and operating at light loads with high fuel economy;

8. Attainment of variable compression ratios in operation to facilitate high power outputs with limited combustion pressures;

These objects and advantages of my invention are combined to achieve a heat engine having superior characteristics for lightweight, high-altitude, subsonic aircraft propulsion as compared with engines of prior art construction. For example, my invention enables the achievement of propeller driven aircraft of lighter weight, greater range, longer flight endurance and greater flight-worthiness by virtue of the advantages it offers in a lightweight, compact, vibrationless diesel powerplant that does not require burdensome heat rejection appurtenances. Still further advantages of my invention will become apparent from consideration of the drawings and ensuing descriptions of them.

DESCRIPTION AND OPERATION OF INVENTION

Figure 1:
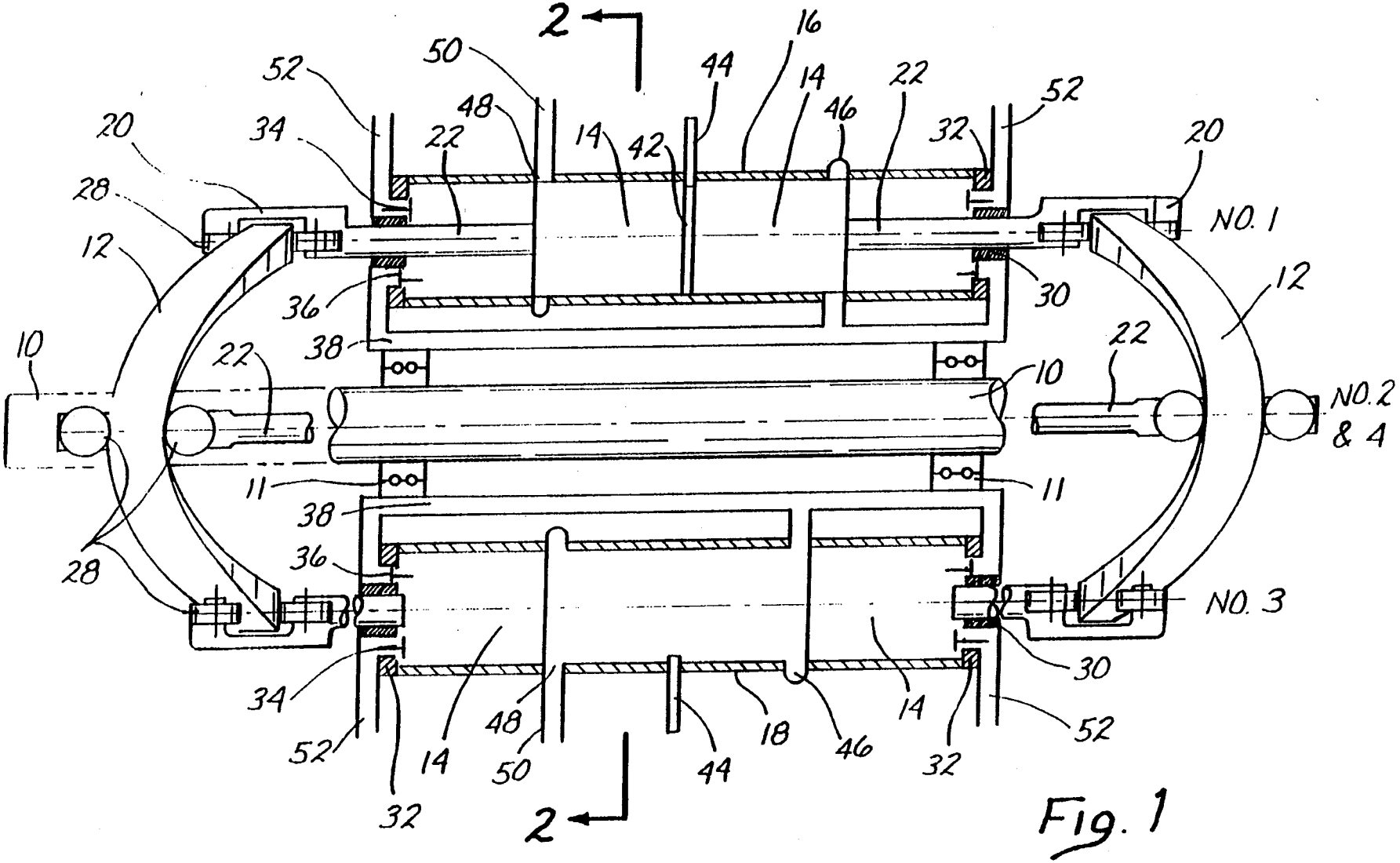
FIG. 1 is a simplified section and cutaway view of an engine assembly constructed according to the present invention showing the axial-cylinder, opposed-piston layout utilizing twin, double-harmonic cams.

FIG. 1 shows a simplified longitudinal section and cutaway view of the engine assembly of the present invention. Shaft 10 passes axially through the center of the assembly, is carried by a pair of bearings 11 in a fixed axial position and mounts a pair of double-harmonic barrel cams 12, one fixed on each end. Cams 12 are radially and axially indexed and placed on shaft 10 with respect to opposed piston pairs 14 such that piston pairs 14 of diametrically opposite cylinders 16 and 18 are in approximately the same position with respect to the center of their respective cylinders so that there is axial and longitudinal symmetry at all times. Cams 12 may be located on shaft 10 with a small angular displacement with respect to each other in order to cause one of piston pairs 14 to be displaced in the cylinder slightly ahead of its opposite. This asymmetric piston phasing feature will be explained more fully in the following in connection with scavenging operations.

As discussed above, opposed pistons 14 in diametrically opposite cylinders are in approximately the same position for purposes of axial and longitudinal symmetry. However, in FIG. 1 cylinder 18 is shown as though shaft 10 had been rotated 90° from the actual position shown. In FIG. 1 opposed pistons 14 are located in cylinder 16 (denoted as No. 1) at their innermost positions as determined by their respective cam follower assemblies 20 which straddle cams 12 and act on pistons 14 through piston rods 22. As shaft 10 is rotated through a 90° angle the followers are displaced in equal and opposite directions by an amount equal to the amplitude of cams 12, which determines the stroke of each piston 14. The positions of pistons 14 at this position (90° out of phase) is indicated by the illustration of cylinder 18 (denoted as No. 3) in FIG. 1 which shows opposed pistons 14 in their outermost positions. Further, rotation of shaft 10 causes pistons 14 to move in and out synchronously and cyclically such that pistons 14 traverse cylinders 16 and 18 in and out four full strokes for each complete revolution of the shaft 10.

Figure 2:
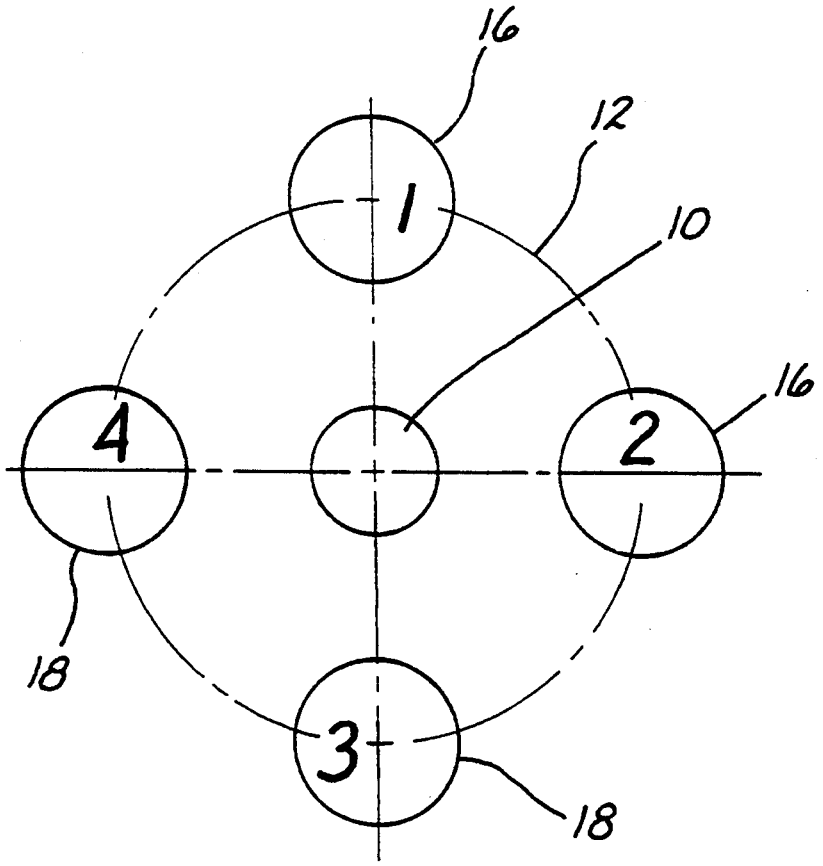
FIG. 2 is a simplified schematic diagram of a four-cylinder engine assembly at Section A—A indicated in FIG. 1.

Pairs of cylinders 16 and 18, such as those designated Nos. 1 and 3 in FIG. 1, which are symmetrical about the shaft 10, are fully balanced dynamically in that all motions of reciprocating masses are in equal and opposite directions and pairs of diametrically opposite cylinders 16 and 18, like those denoted Nos. 1 and 3, are symmetrical about the shaft axis of the engine. Additional pairs of cylinders 16 and 18, e.g. Nos. 2 and 4, may be disposed about the shaft, as in the four cylinder arrangement shown in FIG. 2, without disturbing the balance of the engine. The cam and follower arrangement corresponding to the layout of FIG. 2 is indicated in FIG. 1, where the cylinder pair out of plane are denoted Nos. 2 and 4.

Figure 3:
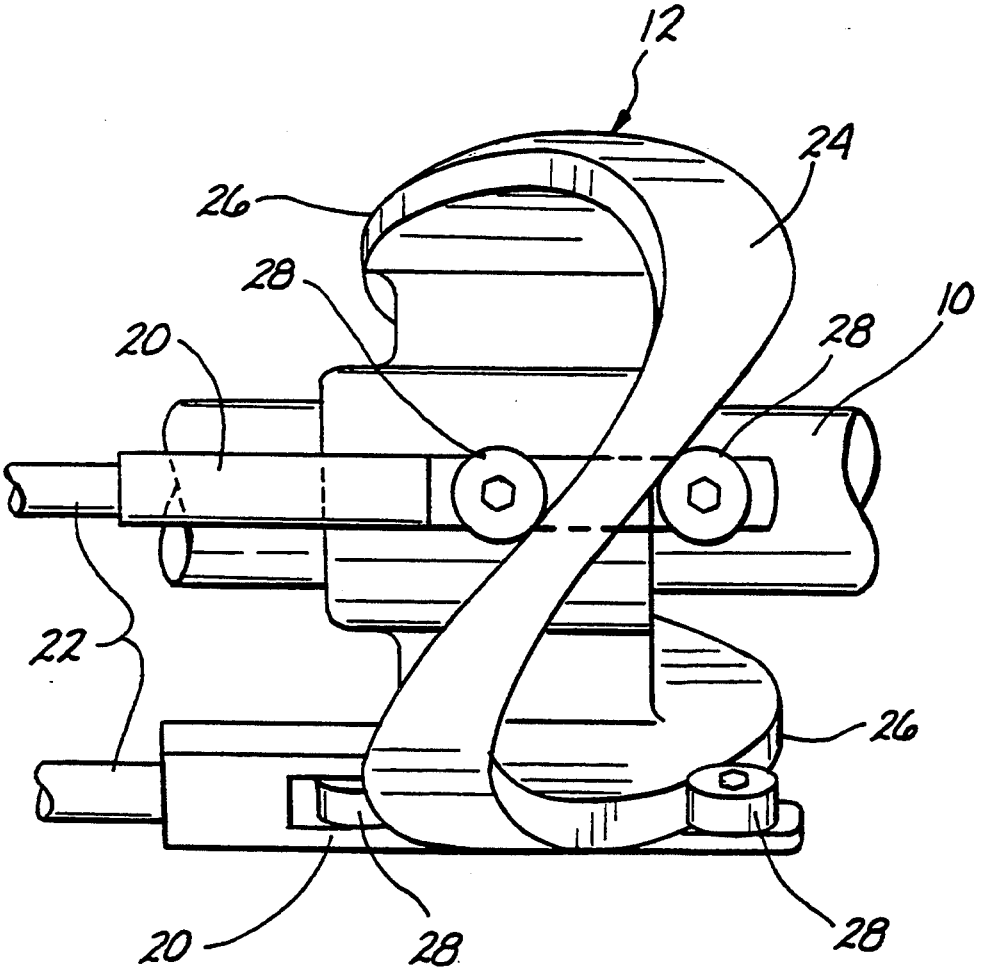
FIG. 3 is a pictorial illustration of a double harmonic barrel cam of the present invention, with roller followers.
Figure 4:
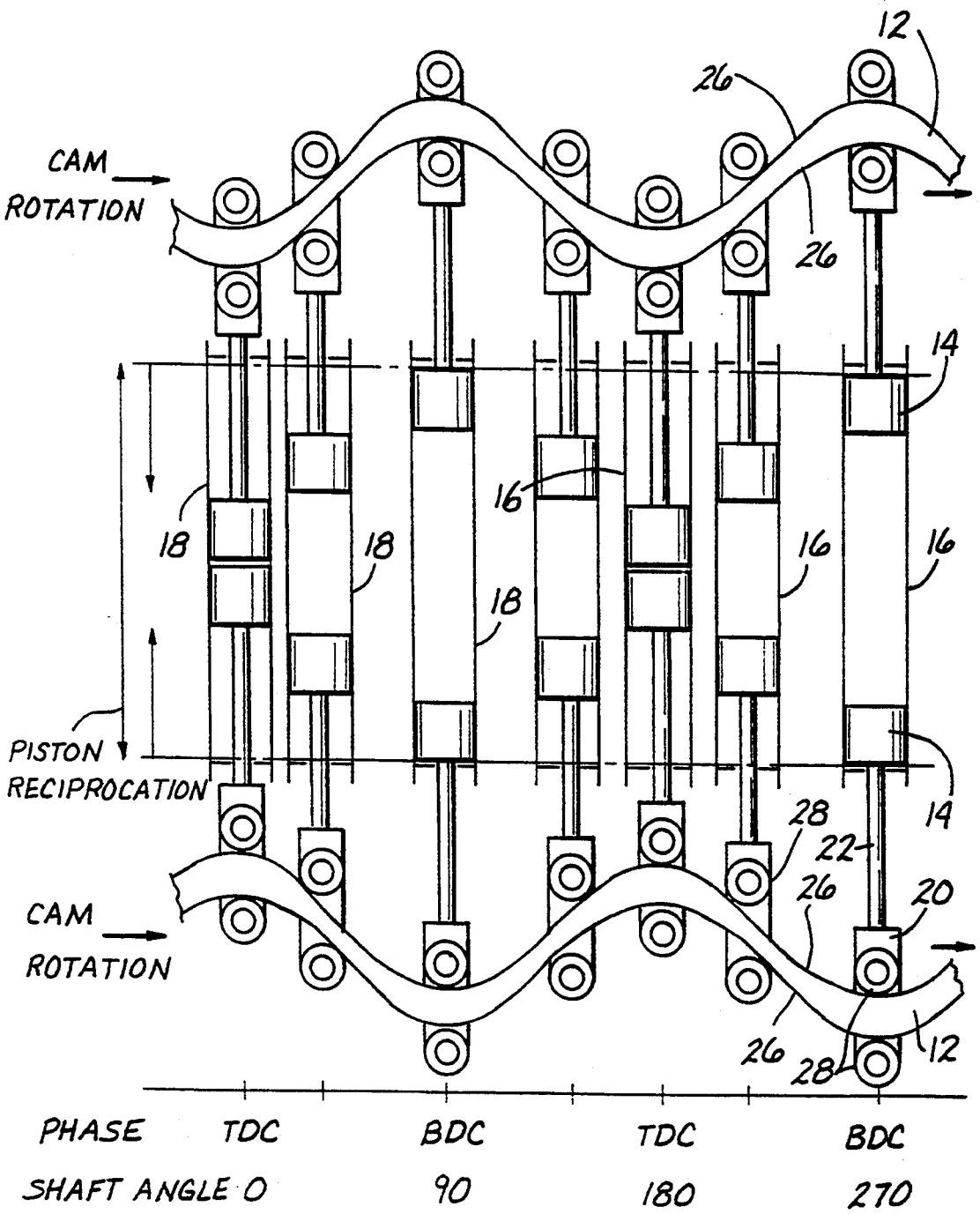
FIG. 4 is a planar schematic diagram illustrating the geometrical relationship between piston motion and shaft rotation provided by the twin, double-harmonic cam and opposed piston arrangement of the present invention.

Cams 12 shown in FIG. 1 are illustrated in FIG. 3 as having a cylindrical periphery 24, the radial faces 26 of which are contoured to produce simple harmonic motion in the axial direction of the fixed-center roller followers 28 which straddle cams 12 in their follower assemblies 20. As described above, the cam profiles describe two complete cycles per revolution and are thus double harmonics. FIG. 4 illustrates how this harmonic piston motion is developed by showing the peripheral line of contact as if it were in a plane so that rotary motion can be depicted in a linear fashion. Note that as roller followers 28 straddle cam plate 12 they are constrained to reciprocate linearly as cam 12 rotates. Axial constraints are provided by pistons 14 in their cylinder bores 16 and 18 and piston rods 22 which have crosshead bearings 30, as shown in FIG. 1. It will also be seen that the contour of cam 12 restrains roller follower assemblies 20 from rotating about the axis of piston rod 22 and also from moving laterally when tangential forces are imparted by cam 12 on rollers 28, and vice versa.

Figure 5A:
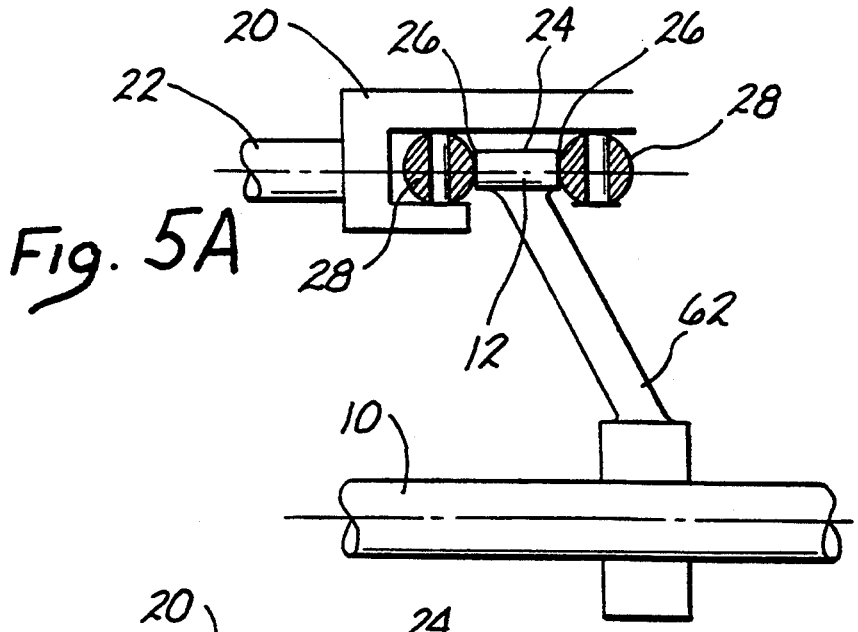
FIG. 5A shows spherically-ground roller followers riding on a narrow plane-radial cam face, in one embodiment of the present invention.
Figure 5B:
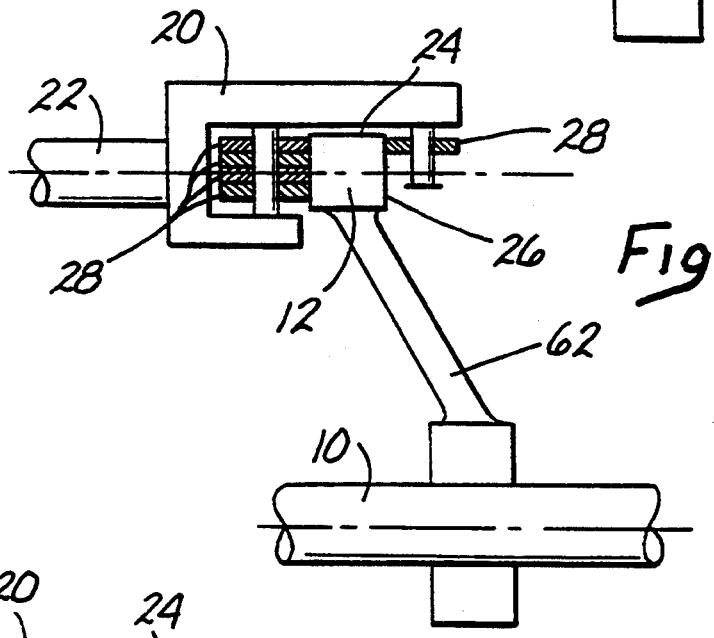
FIG. 5B shows multiple cam roller followers riding on a wide plane-radial cam face, in another embodiment of the present invention.
Figure 5C:
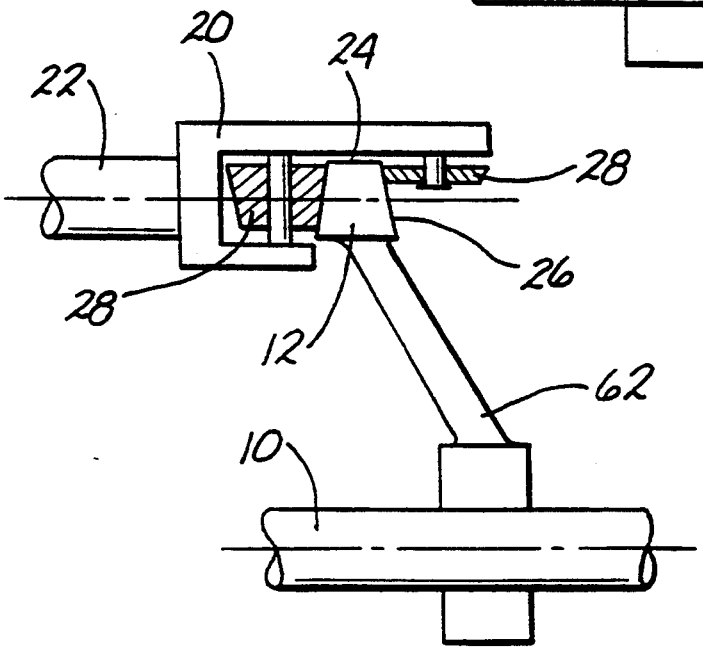
FIG. 5C shows tapered roller followers riding on a tapered cam face, in yet another embodiment of the present invention.

Cam faces 26 may be plane radial surfaces, that is, cam faces 26 may be flat and normal to the axis of rotation. Thus, the peripheral speed of cam faces 26 varies with the radius from the centerline of shaft 10 such that a rigid cylindrical roller follower 28 of finite thickness will have pure rolling contact with cam surface 26 at only one radial point. A difference in surface speed will then exist between roller 28 and cam surface 26 inside and outside this contact point, resulting in a condition known as scuffing. This condition can be remedied with this planar, radial surface 26 by using rollers 28 having a spherically ground surface, as shown in FIG. 5A, to contact flat cam surface 26 which may be narrow in width. When such surfaces in contact are sufficiently hard, the area of contact is very small and differential motion or scuffing is negligible. An alternative configuration that reduces the scuffing tendency is shown in FIG. 5B. When a wider cam face 26 is used, there is a greater area of contact. Multiple rollers 28, that are free to rotate at differing velocities, are used to reduce stress concentration. Yet another low-scuff configuration is shown in FIG. 5C which utilizes tapered roller 28 that contacts tapered cam face 26 at a single line of contact. The taper of rigid roller 28 allows it to contact cam face 26 in a line without scuffing because its diameter increases with the radius of cam contact at such a rate that its peripheral speed can match the peripheral speed of cam surface 26 at every point along its line of contact.

FIG. 1 also shows that pistons 14 are designed to be double-acting by enclosing the outer ends of the cylinders 16 and 18 with head 32 that contains crosshead bearing and sealing gland 30 as well as automatic valving 34 and 36 to accomplish compressor operation. When piston 14 moves inward, a suction develops behind it which opens spring-loaded poppet valve 34 controlling the scavenge air intake port, admitting air into the cylinder. When piston 14 moves outward, pressure develops ahead of it causing scavenge air intake valve 34 to close and scavenge air discharge valve 36, also shown as a spring loaded poppet, to open allowing flow to discharge into charge air manifold 38 under pressure.

The other end of the pistons 14, at the center of the cylinder 16 or 18, forms combustion chamber 42 of the engine. Opposed piston pairs 14 come together in the center of the cylinder where fuel injection 44 and/or ignition means are located. Note in FIG. 1 that cylinders 16 and 18 are provided with peripheral ports 46 and 48 located in the space between opposed pistons 14, just inside the outermost point of their travel. Thus, ports 46 and 48 are opened and closed by the piston motion in the neighborhood of their outermost positions. Ports 46 located at one end are manifolded to the charge air manifold 38 and thus function as charge air admission ports. Ports 48 are manifolded to exhaust ducting 50 and function as combustion gas exhaust ports. Ports 46 and 48 are opened on the outward movement of the pistons on every stroke allowing air to pass into cylinder 16 or 18 at one end and combustion gases to exhaust from the cylinder at the other end. This accomplishes a uniflow type of cylinder scavenging which is the most complete and efficient process known for that purpose. As will be described more fully in the following, the arrangement of FIG. 1 accomplishes a self-aspirated, uniflow-scavenged, two-stroke cycle heat engine process every half revolution of its shaft when proper means, as are known in the art, for admitting fuel and igniting the same are provided. Moreover, such a two-stroke cycle is performed by each piston 14 in every cylinder such that piston 14 delivers two power strokes per shaft revolution. Furthermore, pairs of cylinders will deliver eight complete power strokes per shaft revolution.

The firing order of the engine of the present invention may now be described as follows. Pairs of diametrically opposite cylinders, 16 and 18, such as Nos. 1 and 3 shown in FIGS. 1 and 2 are fired simultaneously. Thus a two cylinder embodiment would fire twice per shaft revolution at shaft angles 0° and 180°, etc. This firing order may be seen by reference to FIG. 4 which shows pistons 14 in cylinders 180° apart are at their innermost travel at the same time and such positions are repeated every 180° of shaft rotation. The firing order of the four-cylinder embodiment depicted in FIG. 2 would be Nos 1 and 3 firing at 0°, 180°, 360°, etc. and Nos. 2 and 4 firing at 90°, 270°, 450°, etc. From this it is clear how the firing order is developed for 6, 8, 10 and larger numbers of cylinder pairs of equal spacing as may be embodied in the engine of the present invention.

As indicated previously, cams 12 may be fixed to shaft 10 with a small angular difference between them. This allows piston 14 controlling combustion gas exhaust port 48 to be timed ahead of its opposed piston 14 which controls scavenge air admission port 46. As exhaust port 48 would be opened slightly ahead of intake port 46, the cylinder pressure can be substantially relieved before intake air would be admitted to cylinder 16 or 18 through the later opening intake port 46. This type of timing substantially improves the exhaust scavenging process. It follows also that exhaust port 48 will be closed ahead of intake port 46, thereby permitting a greater degree of trapping and charging of the cylinder by the air available in charge air manifold 38. This type of port timing is known in the art as unsymmetrical scavenging and has been found to be highly effective in obtaining maximum two-stroke cycle engine performance.

Figure 6:
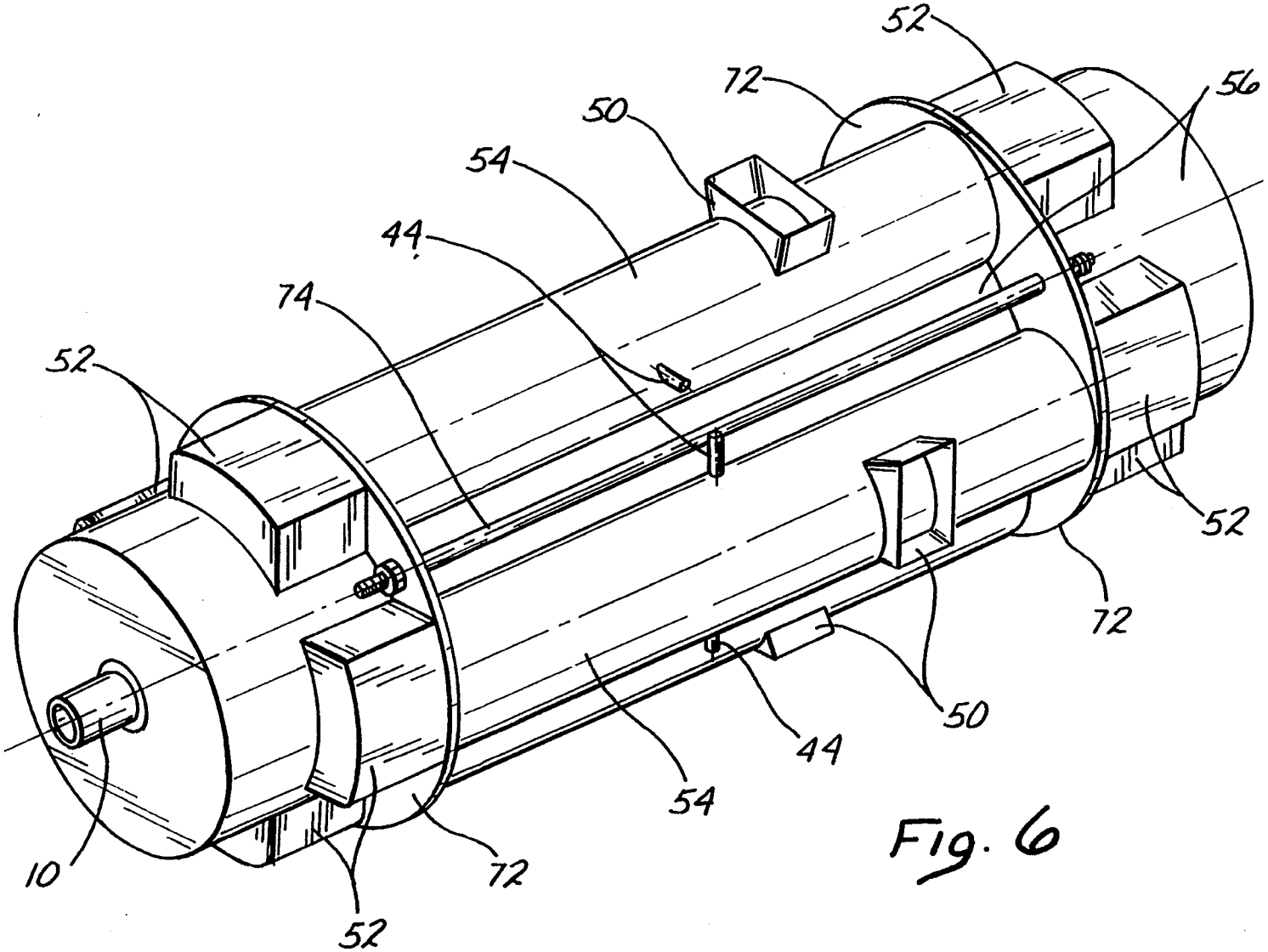
FIG. 6 shows an isometric view of the outboard profile of the engine of the present invention, showing modular cylinders mounted around an axial output shaft and the location of intake, exhaust and fuel injection features.

The configuration of the engine of the present invention as described in FIGS. 1 and 2 allows separate cylinder/piston assembly modules 54 to be mounted about a central cam and shaft assembly as shown pictorially in FIG. 6. Since all pressure forces are contained within piston/cylinder modules 54, a net force can exist only along the axis of the freely moveable pistons 14 that are constrained by their cylinder bores and piston rods 22, guided in crosshead bearings 30, to move only in this manner. These axial forces vary in magnitude but do not reverse in direction because gas pressures on the pistons are such that they always act outwardly and axially. This means that the cams which restrain these forces will always be loaded axially in only the outward direction and such forces will be contained by tension within the shaft 10 connecting the two cams 12 as shown in FIG. 1. Thus, the cylinder assemblies are not subjected to any forces tending to stretch them, separate them or move them with respect to the engine assembly.

As described above, pistons 14 act on cams 12 and are acted upon by cams 12 via rolling contact followers 28. Followers 28 contact cam surfaces 26 during operation at an angle to the axis which varies according to the laws of harmonic motion. This geometry ordains that the axial force in piston rod 22 can be applied by roller 28 on cam surface 26 and vice versa, only in a direction normal to cam surface 26 at the point of contact. This usually oblique contact results in the manifestation of forces perpendicular to the piston axis and tangential to the plane of cam 12 resulting in torsion in the cam wheels and shaft. Because the cam profiles are arranged in substantially equal and opposite positions, the periodic torques that develop are synchronized and additive giving rise to a net torque on the shaft. Because of the symmetry of the cam/piston arrangement these tangential forces produce pure couples about the shaft axis without any rocking moments on the engine structure itself. Variations in the torque magnitude resulting from the intermittent cylinder firing order give rise to a shaft torque variation known as torsional vibration. However, such torsional oscillations that do develop are not of a sufficient magnitude that they can reverse the direction of the net torque experienced in the shaft. This characteristic is helpful in absorbing such vibration in the rotational inertia of the rotary assembly and other techniques known in the art. Such torsional vibration is also minimized by the relatively large number of piston strokes and cycles per revolution produced in this engine configuration.

The lateral force component giving rise to the torque would create a side load on piston rod 22 and thus piston 14 fixed to it, if it were it free to move laterally. However, as pointed out above, the roller followers 28 that straddle cam plate 12 are restrained by the cam contour against such motion thereby preventing such lateral forces from being applied to piston rod 22. As a result, piston 14 is maintained free of side loads that would give rise to friction in its movement within cylinder 16 or 18. Further, roller followers 28 minimize the friction that can occur in contacting cam surfaces 26 as shown in FIG. 5.

As indicated above, the roller follower assembly 20 of the invention is captured by cam plate 12 such that lateral and rotary motion of the piston rod 22 is prevented. It is also shown how the symmetry of the invention results in a perfect balance of longitudinal and lateral shaking forces and rocking moments.

Figure 7:
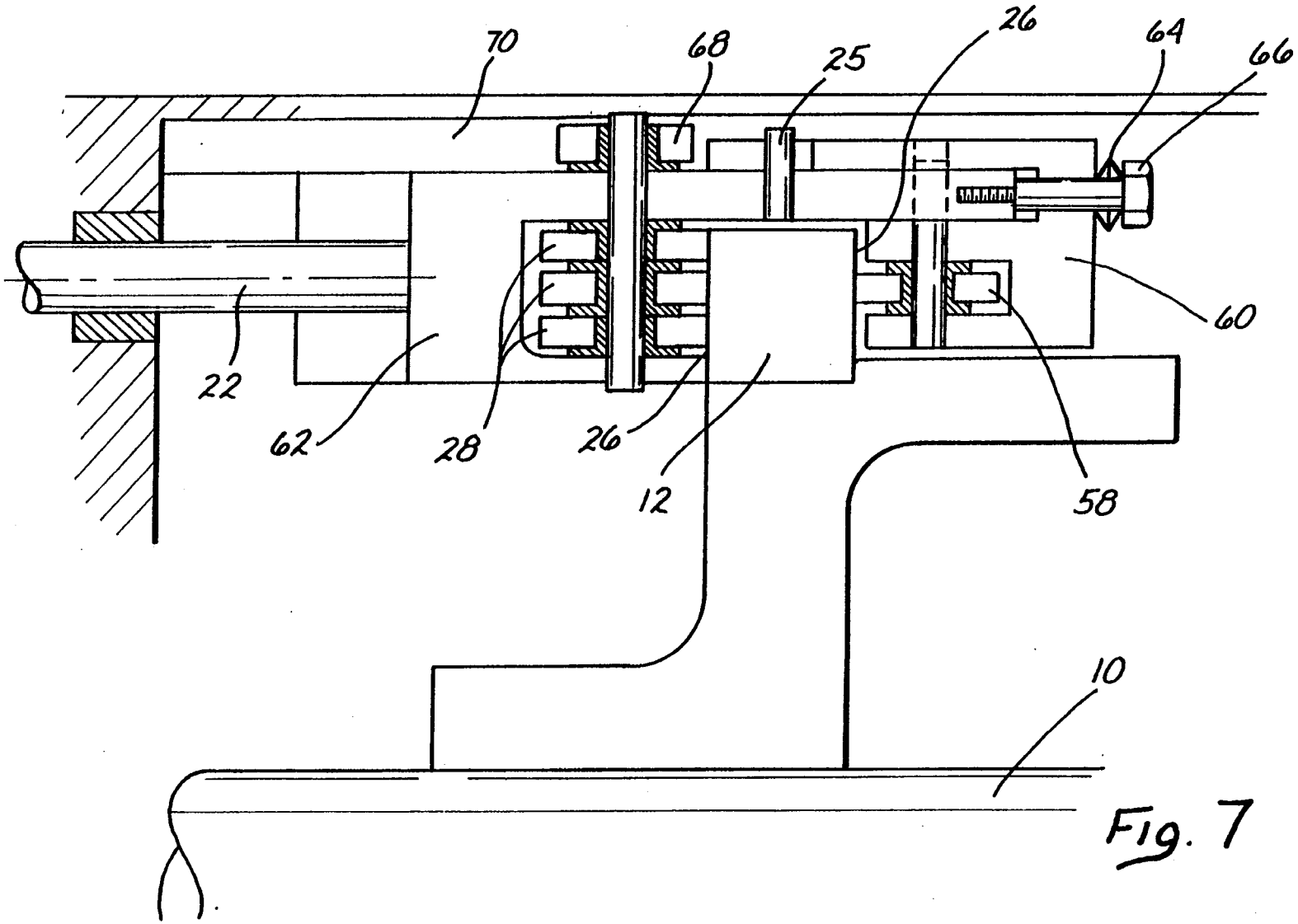
FIG. 7 shows a cam roller follower assembly of one embodiment of the present invention, illustrating its lash and twist elimination features.

Further means of perfecting the internal control of the forces and reactions occurring in and about roller follower 28 owing to its contact with cam 12 are illustrated in FIG. 7. A significant result of two-stroke cycle operation is that rollers 28 on the piston side of cam 12 are always loaded against cam 12 whereas the opposite or slack side roller 58 is loaded only as a consequence of and in reaction to the load imposed on loaded side roller 28. In the presence of lash or clearance between rollers 28 and cam surface 26, some deflection must occur in the follower/piston assembly before slack side roller 58 can engage cam surface 26 and support the follower against the side load produced by the loaded follower 28. Such deflection would bring piston rod 22 into contact with crosshead bearing 30 thereby increasing its load and the friction related thereto. A further consequence of such clearance and any unevenness in the cam profile and rolling resistance of the rollers is that slight torques about the piston rod axis can occur tending to rotate the piston and possibly produce a chattering motion about that axis. As shown in FIG. 7, slack side roller 58 is mounted in a sliding mount 60 that is restrained to move with respect to main fork 62 only along the longitudinal axis, mount 60 being preloaded toward cam 12 by sets of belleville springs 64 captured by shoulder bolts 66 fastened to main fork 62. By such means, slack-side roller 58 is forced into contact with cam surface 26 at all times and under virtually constant force regardless of wear, tolerances or clearances in the parts. An additional feature is also shown in FIG. 7 consisting of guide roller 68 mounted above main fork 62 on the same axis as loaded-side rollers 28. Guide roller 68 is constrained to move only in an axial direction by guide rails 70 fitted into the periphery of the cam housing. By these means, cam follower assembly 20 is constrained to move only in an axially direction with a minimum of lateral or rotary deflections.

As indicated above, the modular piston/cylinder assemblies 54 are practically free of unbalanced forces that would tend to disturb their location in the engine assembly. This permits a type of engine construction that differs markedly from the prior art in which the cylinders provide the main structural element for containing the reciprocating loads. In the present invention cylinders 16 and 18 are free of such loads, which permits them to be made as identical modular assemblies as illustrated in FIG. 6 and to be attached comparatively lightly to a lightweight center housing member that primarily provides location and radial support for the shaft, its main bearings and the cylinders. Further, this arrangement facilitates the fabrication of such cylinder modules from simple shapes of thermally tolerant materials such as polycrystalline graphite billet and monolithic ceramics, whereby cooling and lubrication can be avoided. The center housing may also be fabricated in lightweight graphite billet material whereby savings in weight, cost and tooling may be obtained.

The details of the fabrication, fastening and joining of the modular cylinders to the center housing have been omitted here because suitable arrangements are many and varied as are known to those skilled in the art. As illustrated in FIG. 6, however, one preferred embodiment consists of clamping cylinder modules 54 between flanges 72 fitted to each end of the center housing (not shown). Flanges 72 are provided with recesses to register and locate the cylinders at each end. Flanges 72 would be sufficiently resilient to clamp each cylinder assembly 54 firmly when a set of tie bolts 74 passing between them and longitudinally beside each cylinder module 54 are tightened.

The engine of the present invention can provide a means of varying its compression ratio by allowing a running adjustment of the clearance volume between pistons 14. In one embodiment, shown in FIG. 8A, a moveable rim 78 for mounting cam ring 12 is fitted to cam wheel 80 to slide back and forth freely in an axial direction. The annular space 82 created by such axial motion is filled with oil which acts as a hydraulic medium under controllable pressure to vary the volume of space 82 displacing rim 78 with respect to wheel 80, thereby changing the relative locations of the opposing pistons 14 as fixed by cams 12. Space 82 is sealed against leakage by O-rings 84 and is ported via drilled passages 86, 88 and 90 to a source of control oil (not shown). Rim 78 is constrained to move axially by the lengths of space 82 and slot 92 by means of detent 94 fastened to rim 78 in slot 96 by bolt 98. Rotation of rim 78 with respect to wheel 80 is prevented by detent 94 captured in slots 92 and 96.

Figure 9:
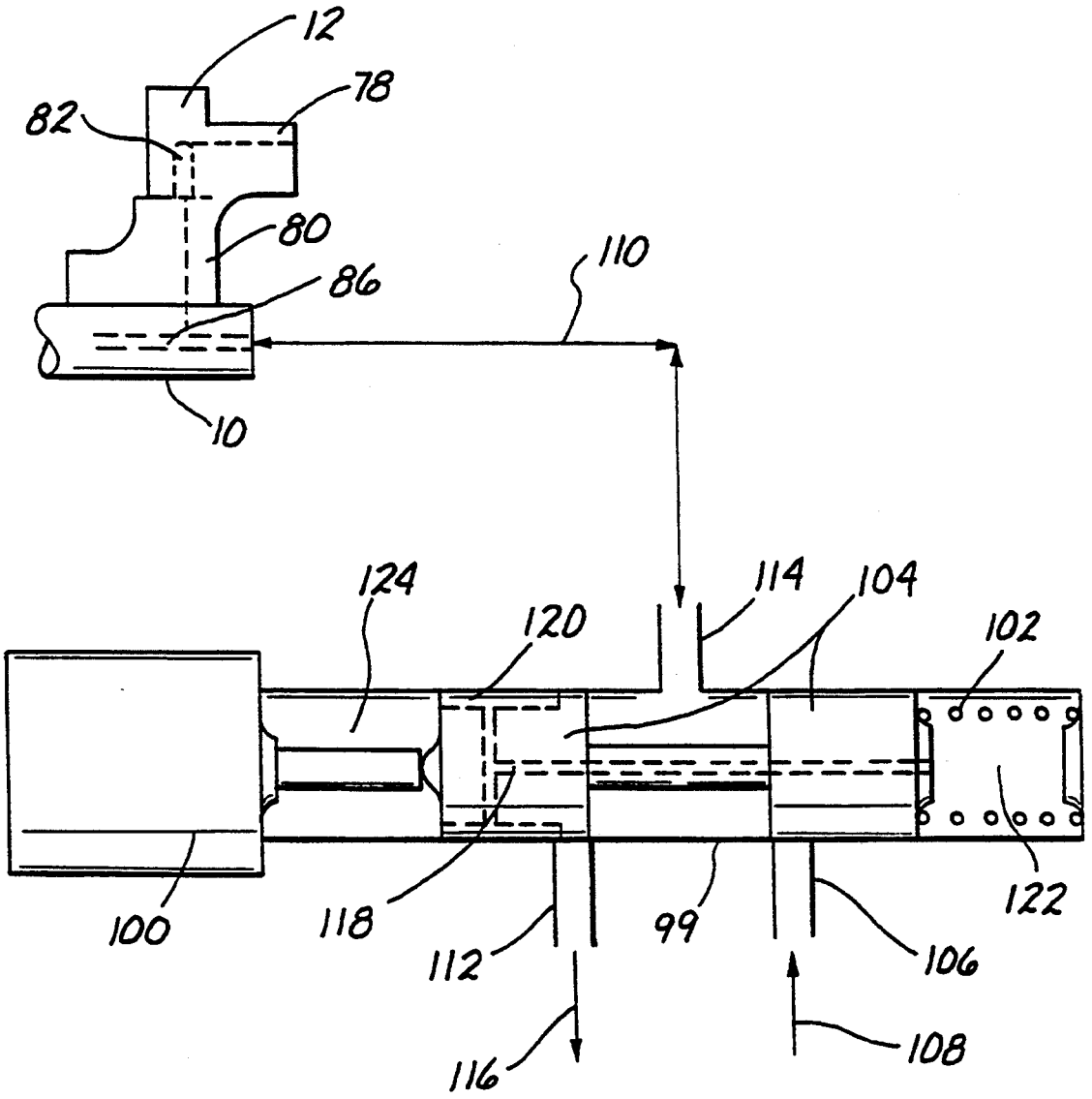
FIG. 9 shows a schematic diagram of a hydraulic control system of the present invention, which varies the cam position in operation.

Control of the oil for displacing the cam 12 with respect to shaft 10 is shown in FIG. 9 using a three-way spool valve controlled by linear servo 100 acting against spring 102. Servo 100 moves spool 104 uncovering port 106 allowing pressurized oil 108 to enter the shaft supply port 110 and displace cams 12 in the inward direction. To allow cams 12 to move in the outward direction, servo 100 is withdrawn under the impetus of spring 102 closing port 106 and opening port 112. This allows port 114, which connects to shaft supply port 110, to drain into line 116 returning oil to a reservoir (not shown). An equilibrium position of cam 12 is maintained when servo 100 positions spool 104 such that both ports 106 and 112 are closed fixing the volume of oil contained in the passages 110, 86, 80 and space 82 at a constant value. The movement of spool 104 is facilitated by vent passages 118 and 120 connecting spring chamber 122 and servo chamber 124 to line 116 via port 112. This control embodiment is typical of many suitable electrohydraulic control schemes known in the art.

Figure 8B:
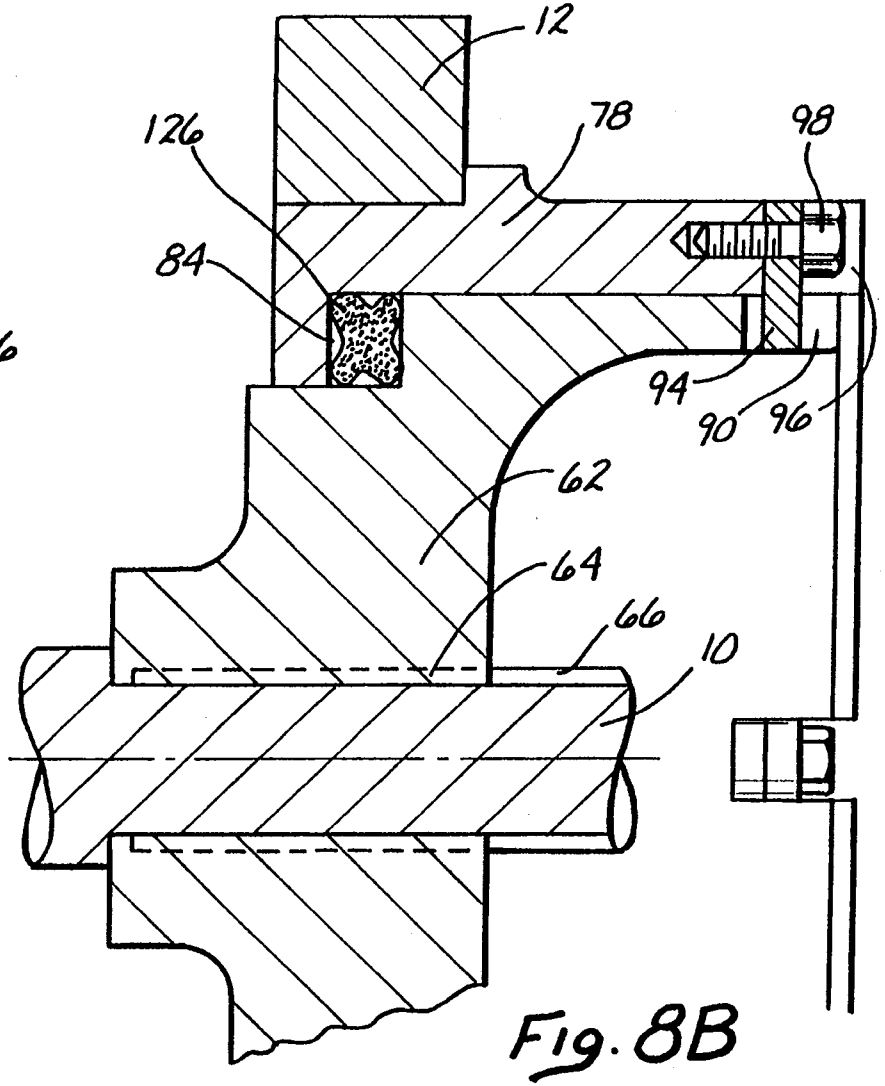
FIG. 8B shows a partially sectioned view of another embodiment of the cam wheel assembly of the present invention, having an elastomerically adjustable cam position.
Figure 8A:
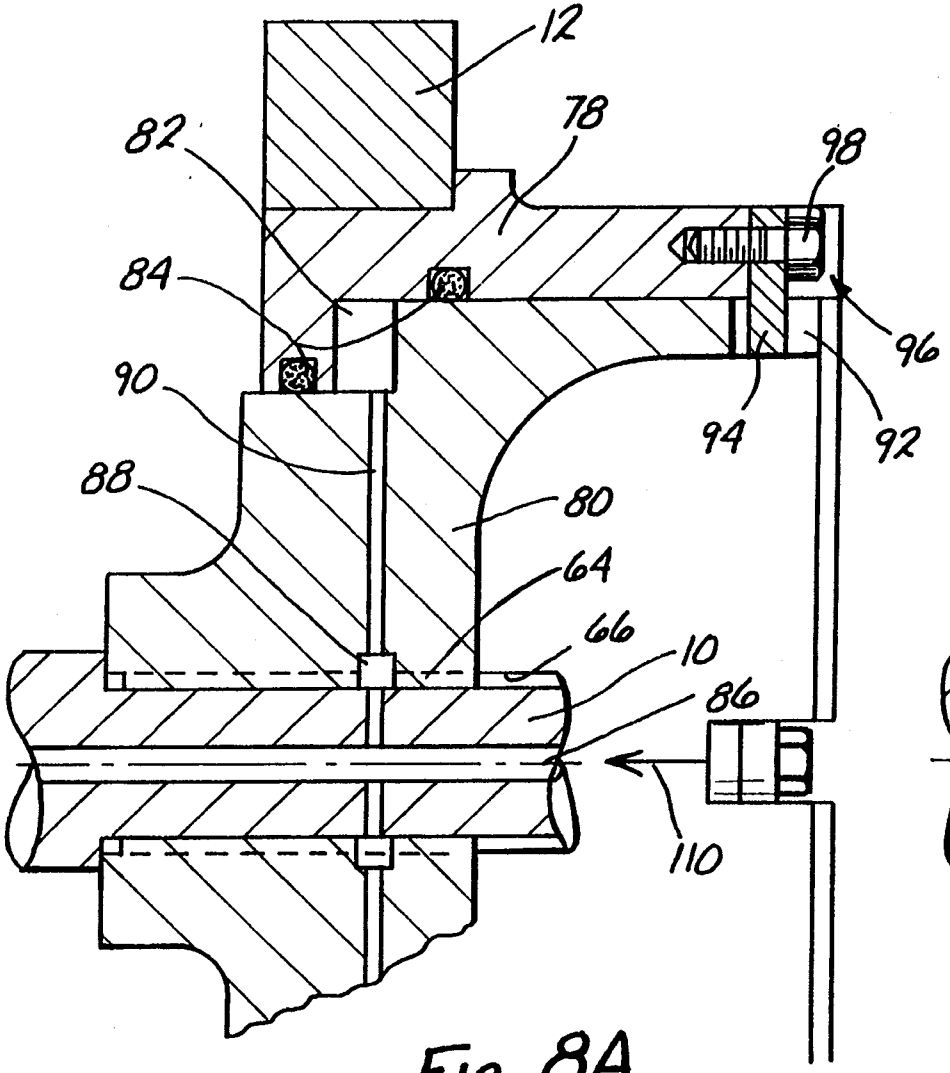
FIG. 8A shows a partially sectioned view of one embodiment of the cam wheel assembly of the present invention, having a hydraulically adjustable cam position.

An alternative embodiment of the variable compression ratio control of the present invention is shown in FIG. 8B wherein space 82 is filled with a viscoelastic medium such as an elastomeric or rubber ring 126. Ring 126 is compressible to a fraction of its relaxed volume such that the pressure of pistons 14 against cam ring 12 automatically changes the volume of space 82 in the direction of increased clearance volume with increased average cylinder pressure. This mode of compression ratio control is appropriate for turbocharged diesel engine applications in which a high compression ratio is desirable for starting, idling and light load operation whereas a reduced compression ratio has advantages in high output operation.

CONCLUSION AND SCOPE OF INVENTION

Thus, it is readily seen that the engine of the present invention provides a highly compact, lightweight, balanced, thermally tolerant and efficient structure and mechanism for producing high torque outputs without supplemental cooling or lubrication.

The axial cylinder, opposed-piston arrangement provides a low frontal area which is a highly valuable characteristic in an aircraft engine. The present invention, though particularly advantageous in aircraft applications, is also applicable to any internal combustion engine application.

The twin, double-harmonic cam arrangement along with the opposed-piston and symmetrical cylinders operating in a two-stroke cycle provides a perfect balance of the forces and moments that would otherwise cause vibration while also providing a maximum utilization of cylinder displacement in the production of shaft torque. This reduced vibration provides noise reduction and reduces structural fatigue, regardless of whether the engine is in an automobile, aircraft, or reciprocating compressor. Furthermore, the enhanced torque output is beneficial in any of the aforementioned applications in that it is capable of simplifying the transmission, increasing power train efficiency, and enhancing the power to weight ratio.

The engine of the present invention may also be utilized wherever thermally tolerant materials would be advantageous. It can be seen by those skilled in the art how the engine structure may be fabricated using various thermally tolerant materials and in various combinations.

Further ramifications of the present invention are that no external aspiration or scavenging accessories are required to implement two-stroke cycle operation and that side loads on all sliding surfaces are prevented as well the scuffing of rolling contact members. Since all the rotational elements and cam followers are of the rolling contact type, and the virtually unloaded sliding members may be made of thermally tolerant material, such as graphite, the engine of the present invention may be self-lubricated and passively cooled. Thus, any reciprocating heat engine or compressor could utilize the present invention and its concomitant benefits of self-lubrication and self-cooling, thereby simplifying its structure.

While the above description of the present invention contains many specific details, these should not be construed as limitations on the scope of the invention, but rather as an exemplification of one preferred embodiment thereof. Many other variations are possible. Accordingly, the reader is requested to determine the scope of the invention by the appended claims and their legal equivalents, and not by the examples which have been given.

What is claimed is:

1. A reciprocating internal combustion engine comprising:

at least two cylinders, each of said cylinders having a first end and a second end;

a pair of opposed pistons in each of said cylinders, each of said pistons comprising a piston head and a piston rod and each of said cylinders further comprising a pair of crosshead bearings adapted to guide each of said piston rods; and a pair of double harmonic barrel cams mounted on a shaft parallel to and symmetrical with said cylinders and connected to said piston rods to impart axial motion thereto.

2. The engine of claim 1 wherein each of said cylinders comprises an injection port at the approximate midpoint of said cylinder, an exhaust port between said first cylinder end and said approximate midpoint and an intake port between said second cylinder end and said approximate midpoint.

3. The engine of claim 2 wherein each of said cylinders further comprises a first crosshead bearing at said first cylinder end and a second crosshead bearing at said second cylinder end, wherein each of said crosshead bearings comprises:

a suction port controlled by an automatic suction check valve adapted to permit available air to flow only into said cylinder; and a discharge port controlled by an automatic discharge check valve adapted to permit gas to flow only out of said cylinder.

4. The engine of claim 3 wherein each of said crossheads forms with one of said piston heads a compression region to permit said piston head to compress gas.

5. The engine of claim 4 further comprising a charge air manifold connecting each of said discharge ports to said intake port to bring compressed gas though said intake port for further compression and combustion by said piston heads.

6. The engine of claim 1 wherein said piston heads are comprised of thermally tolerant and self lubricating materials.

7. The engine of claim 6 wherein said piston heads are comprised at least partially of graphite.

8. The engine of claim 1 wherein each of said cams further comprises:

a centrally disposed cam wheel affixed to said shaft;

an axially movable cam rim mounted to the peripheral surface of said cam wheel; and a cam ring affixed to the peripheral surface of said cam rim.

9. The engine of claim 8 wherein each of said cams further comprises:

an annular space between said cam wheel and said movable cam rim; and means for controlling the volume of said annular space.

10. The engine of claim 9 wherein said volume controlling means comprises a compressible elastomeric ring.

11. The engine of claim 9 wherein said volume controlling means comprises a hydraulic position servo.

12. The engine of claim 9 further comprising means for preventing said cam rim from rotating on said cam wheel with respect to said shaft.

13. The engine of claim 12 wherein said rotation prevention means comprises:

at least a first radial slot in said cam rim;

at least a second radial slot in said cam wheel;

at least a key bolted into said first slot and cantilevered into said second slot.

14. The engine of claim 1 wherein each of said barrel cams has two radial surfaces and wherein each of said piston rods is connected to one of said cams by a cam follower assembly comprising:

a first cam roller adapted to roll along a first radial cam surface; and a second cam roller adapted to roll along a second radial cam surface;

wherein said cam surfaces are contoured to maintain rolling contact with said first and said second cam rollers at all times.

15. The engine of claim 14 wherein said first and said second cam rollers are spherical in contour, each one providing a point of contact with one of said cam surfaces.

16. The engine of claim 14 wherein said first cam roller is the loaded roller and has a relatively large line of contact with said first radial cam surface.

17. The engine of claim 16 wherein said first cam roller further comprises a plurality of rollers, each of which is in rolling contact with said first radial cam surface.

18. The engine of claim 16 wherein said first cam roller further comprises a frusto-conical roller in rolling contact with said first radial cam surface and wherein said cam surface is tapered to match the surface speed of said roller.

19. The engine of claim 16 wherein said second cam roller is the slack side roller and is adapted to maintain said first cam roller in contact with said first radial cam surface at all times and to restrain the tangential motion of said follower assembly by contacting said second radial cam surface.

20. The engine of claim 19 wherein said follower assembly further comprises means for biasing said second cam roller into contact with said second radial cam surface.

21. The engine of claim 20 wherein said first cam roller is attached to a first fork assembly, said second cam roller is attached to a second fork assembly, said second fork assembly matingly engaged with said first fork assembly and restrained to move along the longitudinal axis of said first fork assembly, and wherein said biasing means comprises belleville springs which are captured by at least one shoulder bolt fastened to said first fork assembly.

22. The engine of claim 21 further comprising a guide roller mounted above said first fork assembly along the same axis as said first cam roller, wherein said guide roller is constrained by guide rails to move co-axially with said first fork assembly.

23. The engine of claim 1 further comprising a rectangular piston rod fitted within a rectangular crosshead bearing and constrained against rotation about its axis.

24. The engine of claim 1 further comprising at least one pair of cylinders, each of said cylinders having a first end and a second end.

25. A reciprocating internal combustion engine comprising:

at least two cylinders, each of said cylinders having a first end and a second end;

a pair of opposed pistons in each of said cylinders, each of said pistons comprising a piston head and a piston rod;

a pair of double harmonic barrel cams mounted on a shaft parallel to and symmetrical with said cylinders and connected to said piston rods to impart axial motion thereto;

a crosshead at each of said ends of said cylinders, each of said crossheads comprising a suction port controlled by an automatic suction check valve adapted to permit available air to flow only into said cylinder and a discharge port controlled by an automatic discharge check valve adapted to permit gas to flow only out of said cylinder, and a bearing adapted to guide one of said piston rods.

26. The engine of claim 25 further comprising at least one pair of cylinders, each of said cylinders having a first end and a second end.

27. A reciprocating internal combustion engine comprising:

at least two cylinders, each of said cylinders having a first end and a second end and comprising an injection port at the approximate midpoint of said cylinder, an exhaust port between said first cylinder end and said approximate midpoint and an intake port between said second cylinder end and said approximate midpoint;

a pair of opposed pistons in each of said cylinders, each of said pistons comprising a piston head and a piston rod; and a pair of double harmonic barrel cams mounted on a shaft parallel to and symmetrical with said cylinders and connected to said piston rods to impart axial motion thereto;

a crosshead at each of said ends of said cylinders, each of said crossheads comprising a suction port controlled by an automatic suction check valve adapted to permit available air to flow only into said cylinder and a discharge port controlled by an automatic discharge check valve adapted to permit gas to flow only out of said cylinder, and a bearing adapted to guide one of said piston rods.

28. The engine of claim 27 further comprising at least one pair of cylinders, each of said cylinders having a first end and a second end.

29. A reciprocating internal combustion engine comprising:

at least two cylinders, each of said cylinders having a first end and a second end;

a pair of opposed pistons in each of said cylinders, each of said pistons comprising a piston head and a piston rod; and a pair of double harmonic barrel cams mounted on a shaft parallel to and symmetrical with said cylinders and connected to said piston rods to impart axial motion thereto, wherein each of said cams comprises:

a centrally disposed cam wheel affixed to said shaft;

an axially movable cam rim mounted to the peripheral surface of said cam wheel;

each of said cams further comprising an annular space between said cam wheel and said movable cam rim and means for controlling the volume of said annular space; and a cam ring affixed to the peripheral surface of said cam rim.

30. The engine of claim 29 further comprising at least one pair of cylinders, each of said cylinders having a first end and a second end.

* * * * *